United States Patent [19]

Creatura et al.

[11] 4,126,458

[45] Nov. 21, 1978

[54] INORGANIC FLUORIDE REVERSAL CARRIER COATINGS

[75] Inventors: John A. Creatura, Webster, N.Y.; Joseph L. Mincer, Lewisville, Tex.

[73] Assignee: Xerox Corporation, Stamford, Conn.

[21] Appl. No.: 823,807

[22] Filed: Aug. 11, 1977

[51] Int. Cl.[2] ..... G03G 9/10; G03G 9/14

[52] U.S. Cl. ..... 96/1 SD; 252/62.1 P; 427/127; 427/216; 148/6.3; 428/403; 252/62.55

[58] Field of Search ..... 252/62.1 R, 62.1 P, 252/62.55; 96/1 SD; 427/216, 127; 148/6.3; 428/403; 29/192 CP

[56] References Cited

U.S. PATENT DOCUMENTS

| | | | |
|---|---|---|---|
| 2,885,313 | 5/1969 | Milliken et al. | 148/6.3 |
| 2,993,819 | 7/1961 | Nessim | 148/6.3 |
| 3,021,231 | 2/1962 | Samuel et al. | 427/216 |
| 3,592,700 | 7/1971 | Toy | 148/6.3 |
| 3,935,340 | 1/1976 | Yamaguchi et al. | 427/216 |
| 3,946,134 | 3/1976 | Sherman | 427/216 |
| 3,947,271 | 3/1976 | Munyel et al. | 252/62.1 P |
| 4,017,342 | 4/1977 | Geisler et al. | 427/216 |

FOREIGN PATENT DOCUMENTS

| | | | |
|---|---|---|---|
| 853,640 | 10/1970 | Canada | 427/216 |

*Primary Examiner*—John T. Goolkasian

[57] ABSTRACT

Electrostatographic developer mixtures comprising finely-divided toner particles electrostatically clinging to the surface of carrier particles comprising a core having an outer coating thereon comprising an inorganic metal fluoride. The carrier particles have negative triboelectric charging properties and are particularly useful in reversal development systems. Imaging processes are also disclosed.

7 Claims, No Drawings

INORGANIC FLUORIDE REVERSAL CARRIER COATINGS

BACKGROUND OF THE INVENTION

This invention relates to electrostatographic guimaging systems and more specifically to improved carrier compositions useful in the development of electrophotographic images.

It is well known to form and develop images on the surface of photoconductive materials by electrostatic means, one of the more basic systems being described by C. F. Carlson in U.S. Pat. No. 2,297,691. This process is also described in other U.S. Patents, including for example, U.S. Pat. No. 2,277,013, U.S. Pat. No. 2,357,809, U.S. Pat. No. 2,551,582, U.S. Pat. No. 3,220,324 and U.S. Pat. No. 3,220,833. The processes described in these patents generally involve the formation of an electrostatic latent charge image on an insulating electrophotographic element whereby the latent image is made visible by a development step wherein the charged surface of the photoconductive element is brought into contact with a suitable developer mixture. As described in U.S. Pat. No. 2,297,691, for example, the resulting electrostatic latent image is developed by depositing on the image a finely divided electroscopic material referred to in the art as toner. This toner is generally attracted to the areas of the layer which retain a charge thereby forming a toner image corresponding to the electrostatic latent image and subsequently the toner image can be transferred to a support surface such as paper. This transferred image can then be permanently fixed to the support surface by using a variety of techniques including heat; however, other suitable fixing methods such as solvent or overcoating treatment may be used.

Numerous methods are known for applying the electroscopic particles to the electrostatic latent image including cascade development, touchdown and magnetic brush belt. In cascade development, as described in U.S. Pat. No. 2,618,552, a developer material comprising relatively large carrier particles having finely-divided toner particles electrostatically clinging to the surface of the carrier particles is conveyed to and rolled or cascaded across the electrostatic latent image bearing surface. The composition of the toner particles is selected in order to have a triboelectric polarity opposite to that of the carrier particles. Thus, as the developer mixture cascades or rolls across the image bearing surface, the toner particles are electrostatically deposited and secured to the charged portion of the latent image and are not deposited on the uncharged or background portions of the image. Carrier particles and unused toner particles can then be recycled. This process is fully described by E. N. Wise in U.S. Pat. No. 2,618,552.

In the touchdown process as described in U.S. Pat. Nos. 2,895,847 and 3,245,823, a developer material is carried to a latent image bearing surface by a support layer, such as a web or sheet and is deposited thereon in conformity with the image.

In magnetic brush development, a developer material comprising toner and magnetic carrier particles is carried by a magnet whereby the magnetic field of the magnet causes alignment of the magnetic carriers in a brush like configuration and this brush is engaged with an electrostatic latent image-bearing surface, causing the toner particles to be attracted from the brush to the electrostatic latent image by electrostatic attraction.

This process is described more fully in U.S. Pat. No. 2,874,063.

Carrier materials used in the development of electrostatographic images are described in many patents including U.S. Pat. No. 3,590,000, the nature of the material used being dependent on numerous factors such as the type of development used, the quality of the development desired, the type of photoconductor employed and other factors including durability. Generally the materials used as carrier surfaces or carrier particles, or coatings thereon, should have a triboelectric value commensurate with the triboelectric value of the toner, in order to enable electrostatic adhesion of the toner to the carrier. Also, the triboelectric properties of the carrier should be relatively uniform in order to allow uniform pickup and subsequent deposition of toner, and such coatings should preferably have a certain hardness primarily for durability purposes but yet be made of materials that will not scratch the plate or drum surface upon which the electrostatic image is initially placed. Carriers should also be selected which are not brittle so as to cause flaking of the surface or particle breakup under the forces exerted on the carrier during recycle as such will cause undesirable effects and could, for example, be transferred to the copy surface thereby reducing the quality of the final image. In addition, there are several types of carrier materials, which although having the proper triboelectric properties, are of limited use in a development system because of the limitations they possess, as described above, which result in undesirable results.

Some recent efforts have focused on the carrier particles, and more specifically the coating of these particles in order to obtain a better development system, particularly a developer that can be recycled and does not cause injury to the photoconductor. However, many of the coatings utilized deteriorate rapidly, particularly when used in a continuous process and sometimes the entire coating separates from the carrier core in the form of chips or flakes which may be caused by poorly adhering coating material that fails upon impact and abrasive contact with machine parts and other carrier particles. Generally, such coated carrier particles cannot be reclaimed and resued, and further poor print quality results when damaged carriers are not replaced. Also to be taken into consideration in the triboelectric and flow characteristics of coated carriers since such properties may be adversely affected when relative humidity is high. Thus, for example, the triboelectric values of some carrier coatings fluctuate when changes in relative humidity occur and such carriers are not desirable for use in electrostatic systems since they adversely afffect the quality of the resulting image.

The importance of carrier coatings takes an increased emphasis in different development techniques. For example, in order to develop a latent image comprised of negative electrostatic charges an electroscopic powder and carrier combination is selected in which the powder is triboelectrically positive relative to the granular carrier. Likewise, to develop a latent image comprised of positive electrostatic charges such as when employing a selenium photoreceptor, an electroscopic powder and carrier mixture is selected in which the powder is triboelectrically negative relative to the carrier.

PRIOR ART

Recent efforts to provide electrophotographic developer materials having improved properties such as triboelectric characteristics include that disclosed by W. J. Kulka et al. in U.S. Pat. Nos. 3,798,167, 3,918,968 and 3,922,382. It is disclosed therein that carrier core materials coated with a fluoropolymer or a mixture thereof with a modifying material when mixed with toner materials is effective in producing a desired polarity and magnitude of triboelectric charge on the toner particles. Control of the magnitude of the triboelectric charge characteristic of the carrier coated with the fluoropolymer is obtained by controlling the curing conditions of the coated carrier. A similar approach is disclosed by C. A. Queener et al. in U.S. Pat. Nos. 3,873,355 and 3,873,356. In U.S. Pat. No. 3,947,271 issued to H. E. Munzel et al., a method of forming a carrier material includes applying a first coating of primer material to ferromagnetic cores wherein the first coating comprises polytetrafluoroethylene and a mixture of chromic and phosphoric acids for reacting with the core to improve adhesion. The primed cores are coated with a second coating of sintered, coalesced particles of polytetrafluoroethylene. A further teaching relating to treated carrier particles for use in electrophotographic processes may be found in U.S. Pat. No. 3,922,381 issued to P. Datta. It is therein disclosed that such carrier particles may be prepared by applying a perfluoro acid to the surface of carrier particles to obtain carrier materials which are long-lived and capable of importing a positive triboelectric charge to electroscopic powders mixed therewith. Thus, it is evident that there is a continuing need for a better developer material for developing electrostatic latent images.

SUMMARY OF THE INVENTION

It is therefore, an object of this invention to provide developer materials which overcome the above-noted deficiencies.

It is another object of this invention to provide carrier materials having excellent adherence of carrier coatings.

It is a further object of this invention to provide carrier coatings which are more resistant to cracking, chipping, and flaking.

It is a further object of this invention to provide coated carrier materials having improved controlled triboelectric characteristics, greatly increased life, and better flowability.

Furthermore, it is an object of this invention to provide improved developer materials, which may be especially useful in an electrostatographic development environment where the photoreceptor is negatively charged.

It is yet another object of this invention to provide improved coated carrier materials having physical and chemical properties superior to those of known developer materials, especially with regard to utilization in a reversal development technique.

The above objects and others are accomplished, generally speaking, by providing a carrier for electrostatographic developer mixtures comprising finely-divided toner particles electrostatically clinging to the surface of carrier particles wherein said carrier particles comprise a core having an inorganic fluoride coating thereon. The inorganic fluoride coatings are generally provided by gas-phase oxidations of carrier surfaces with fluorine, hydrogen fluoride, chlorine trifluoride and oxygen difluoride. In general, the inorganic fluoride coated materials of this invention provide carrier particles which can be used in an electrostatographic development system, especially where development of a negatively charged photoreceptor is desired. In accordance with this invention, it has been found that the coated carrier materials of this invention provide electrostatographic carrier materials which possess desirable negative triboelectric charging properties.

In general, when metals are exposed to fluorine, metal fluoride films having a thickness of from about 10Å to about 100Å are formed. Under anhydrous conditions, these fluoride films are "passive films" and are so closely bonded to the metal surface as to be considered in rather than on the surface of the metals. These films are strongly adherent and are not easily detached from the substrate metal by mechanical shock, as may occur with films or coatings prepared from organic fluoropolymers.

The desired inorganic fluoride carrier coatings may be obtained by gas-phase oxidation of carrier surfaces, particularly those comprising magnetic, conductive metallic surfaces, as to produce a surface coating of metal fluoride thereby resulting in the production of an adherent and substantially continuous inorganic coating thereon. The fluoride coatings formed are close-packed and tightly bonded in the initial molecular layers, and bonds with the metallic surfaces are ionic. More specifically, metallic surfaces exposed to fluorine gas-phase oxidation are believed to oxidize as follows:

$$2M + nF_2 \rightarrow 2MFn$$

where $M$ is the metal such as Fe in steel carrier particles or Ni in nickel carrier particles. It is postulated that all exposed Fe will be oxidized to the $Fe^{+3}$ state and exposed Ni to be oxidized to the $Ni^{+2}$ state. Steel carrier particles oxidized by reaction with hydrogen fluoride obtain $Fe^{+2}$ states, and those reacted with oxygen difluoride yield mixtures of surface oxides and fluorides.

Any suitable fluoride film or coating weight or thickness may be employed to coat the carrier cores. However, a coating having a thickness at least sufficient to form a substantially continuous film is preferred because the carrier coating will then possess sufficient thickness to resist abrasion and minimize pinholes which may adversely affect the triboelectric properties of the coated carrier particles, and also in order that the desired triboelectric effect to the carrier is obtained and also to maintain a sufficient negative charge on the carrier, the toner being charged positively in such an embodiment so as to allow development of negatively charged images to occur.

Any suitable well known coated or uncoated carrier material may be employed as the substrate for the inorganic fluoride coated carriers of this invention. Typical carrier core materials include glass, silicon dioxide, carborundum, ferromagnetic or magnetically-responsive materials such as iron, steel, ferrites, nickel and mixtures thereof. Many of the foregoing and other typical carrier materials are described by L. E. Walkup in U.S. Pat. No. 2,618,551; L. E. Walkup et al. in U.S. Pat. No. 2,638,416; E. N. Wise in U.S. Pat. No. 2,618,552; and C. R. Mayo in U.S. Pat. Nos. 2,805,847 and 3,245,823. An ultimate coated carrier particle having an average diameter between about 30 microns to about 1,000 microns is preferred because the carrier particle then possesses sufficient density and inertia to avoid adherence to the electrostatic images during the development process. Adherence of carrier beads to an electrostatographic drum is undesirable because of the formation of deep scratches on the drum surface during the image transfer and drum cleaning steps, particularly where cleaning is accomplished by a web cleaner such as the web disclosed by W. P. Graff, Jr., et al. in U.S. Pat. No. 3,186,838.

Any suitable finely-divided toner material may be employed with the inorganic fluoride coated carriers of this invention. Typical toner materials include gum copal, gum sandarac, rosin, cumaroneindene resin, asphaltum, gilsonite, phenolformaldehyde resins, rosin modified phenolformaldehyde resins, methacrylic resins, polystyrene resins, epoxy resins, polyester resins, polyethylene resins and mixtures thereof. The particular toner material to be employed obviously depends upon the separation of the toner particules from the coated carrier beads in the triboelectric series. Among the patents describing electroscopic toner compositions are U.S. Pat. No. 2,659,670 to Copley; U.S. Pat. No. 2,753,308 to Landrigan; U.S. Pat. No. 3,079,342 to Insalaco; U.S. Pat. No. Re. 25,136 to Carlson and U.S. Pat. No. 2,788,288 to Rheinfrank et al. These toners generally have an average particle diameter between about 5 and 15 microns.

Any suitable pigment or dye may be employed as the colorant for the toner particles. Toner colorants are well known and include, for example, carbon black, nigrosine dye, aniline blue, Calco Oil Blue, chrome yellow, ultra marine blue, Quinoline Yellow, methylene blue chloride, Monastral Blue, Malachite Green Oxalate, lampblack, Rose Bengal, Monastral Red, Sudan Black BN, and mixtures thereof. The pigment or dye should be present in the toner in a sufficient quantity to render it highly colored so that it will form a clearly visible image on a recording member.

Any suitable conventional toner concentration may be employed with the carrier materials of this invention. Typical toner concentrations include about 1 part toner with about 10 to 200 parts by weight of carrier.

Any suitable well known electrophotosensitive material may be employed as the photoreceptor with the fluoride coated carriers of this invention. Well known photoconductive materials include vitreous selenium, organic or inorganic photoconductors embedded in a non-photoconductive matrix, organic or inorganic photoconductive matrix, or the like. Representative patents in which photoconductive materials are disclosed include U.S. Pat. No. 2,803,542 to Ulrich, U.S. Pat. No. 2,970,906 to Bixby, U.S. Pat. No. 3,121,006 to Middleton, U.S. Pat. No. 3,121,007 to Middleton, and U.S. Pat. No. 3,151,982 to Corrsin.

The results available with the inorganic metal fluoride coated carriers of this invention may be due to many factors. For example, the carriers of this invention may possess strongly adherent coatings which are highly resistant to cracking, chipping, and flaking. When these coated carriers are employed in electrostatographic development systems, carrier life may be unexpectedly extended particularly with respect to carrier coating degradation. Additionally, because of their triboelectric properties, these carrier materials may be employed in reversal development of positively charged images. Further, the coated carriers of this invention may provide exceptionally good life performance, durability, copy quality, quality maintenance, less carrier bead sticking and agglomeration, and also provide improved abrasion resistance thereby minimizing carrier chipping and flaking. In addition, the coated carriers of this invention provide triboelectric values such that they may be used with a wide variety of presently available toners in present electrostatographic processes, and retain a predictable triboelectric value. Thus, the inorganic fluoride coated carrier particles of this invention have desirable properties which permit their wide use in presently available electrostatographic systems.

DESCRIPTION OF PREFERRED EMBODIMENTS

The following examples further define, describe and compare preferred methods of preparing and utilizing the carrier materials of the present invention in electrostatographic applications. Parts and percentages are by weight unless otherwise indicated.

EXAMPLE I

An electrostatographic carrier material is prepared by placing nickel beads having an average particle diameter of about 100 microns in a nickel pressure bomb having a diameter of about 5½ inches and a depth of about 4 inches. The vessel is equipped with a removable flanged top through which pressure and temperature measurements may be made on a continuous basis. The vessel is first evacuated and then filled with dry nitrogen and brought to a temperature of about 300° C. The unreactive nitrogen atmosphere is then removed and the oxidizing atmosphere introduced, in this case, using fluorine gas. Pressure inside the vessel is maintained at about 2 atmospheres and the temperature inside the vessel is maintained at about 300° C. for about 4 hours. At the conclusion of the exposure, the vessel is sequentially evacuated and purged with an inert atmosphere of dry nitrogen while cooling is allowed. Upon observation, the nickel particles will be found to possess a coating of metal fluoride.

A developer mixture is prepared by mixing the fluoride coated particles with a toner material comprising a styrene-n-butyl methacrylate copolymer and a furnace carbon black wherein the toner material has an average particle size of between about 10 to 15 microns. The coated cores are blended with the toner material in an amount of about 1 part toner material per about 100 parts of carrier material. The developer mixture is used to develop a negatively charged photoconductive surface bearing an electrostatic latent image. The developer mixture will produce images which are of excellent quality with satisfactory background levels.

EXAMPLE II

An electrostatographic carrier material is prepared by placing SAE No. 1015 carbon steel beads (Metals Handbook, 8th Ed., Vol. 1, page 62) having an average particle diameter of about 100 microns in a nickel pressure bomb having a diameter about 5½ inches and a depth of about 4 inches. The vessel is equipped with a removable flanged top through which pressure and temperature measurements may be made on a continuous basis. The vessel is first evacuated then filled with dry nitrogen and brought to a temperature of about 300° C. The unreactive nitrogen atmosphere is then removed and the oxidizing atmosphere introduced, in this case, using fluorine gas. Pressure inside the vessel is maintained at about 2 atmospheres and the temperature is maintained at about 300° C. for about 4 hours. At the conclusion of the exposure, the vessel is sequentially evacuated and purged with an inert atmosphere of dry nitrogen while cooling is allowed. Upon observation, the steel particles will be found to possess a coating of metal fluoride. A developer mixture is prepared by mixing the fluoride coated particles with a toner material comprising a styrene-n-butyl methacrylate copolymer and a furnace carbon black wherein the toner material has an average particle size of between about 10 to 15 microns. The coated cores are blended with the toner material in an amount of about 1 part toner material per about 100 parts of carrier material. The developer mixture is used to develop a negatively charged photoconductive surface bearing an electrostatic latent image. The developer mixture will produce images which are of excellent quality with satisfactory background levels.

EXAMPLE III

An electrostatographic carrier material is prepared by placing nickel beads having an average particle diameter of about 100 microns in a nickel pressure bomb having a diameter of about 5½ inches and a depth of about 4 inches. The vessel is equipped with a removable flanged top through which pressure and temperature measurements may be made on a continuous basis. The vessel is first evacuated and then filled with dry nitrogen and brought to a temperature of about 100° C. The unreactive nitrogen atmosphere is then removed and the oxidizing atmosphere introduced, in this case, using chlorine trifluoride. Pressure inside the vessel is maintained at about 4 atmospheres and the temperature inside the vessel is maintained at about 100° C. for about 1 hour. At the conclusion of the exposure, the vessel is sequentially evacuated and purged with an inert atmosphere of dry nitrogen while cooling is allowed. Upon observation, the nickel particles will be found to possess a coating of metal fluoride. A developer mixture is prepared by mixing the fluoride coated particles with a toner material comprising a styrene-n-butyl methacrylate copolymer and a furnace carbon black wherein the toner material has an average particle size of between about 10 to 15 microns. The coated cores are blended with the toner material in an amount of about 1 part toner material per about 100 parts of carrier material. The developer mixture is used to develop a negatively charged photoconductive surface bearing an electrostatic latent image. The developer mixture will produce images which are of excellent quality with satisfactory background levels.

EXAMPLE IV

An electrostatographic carrier material is prepared by placing SAE No. 1015 carbon steel beads (Metals Handbook, 8th Ed., Vol. 1, page 62) having an average particle diameter of about 100 microns in a nickel pressure bomb having a diameter about 5½ inches and a depth of about 4 inches. The vessel is equipped with a removable flanged top through which pressure and temperature measurements may be made on a continuous basis. The vessel is first evacuated and then filled with dry nitrogen and brought to a temperature of about 100° C. The unreactive nitrogen atmosphere is then removed and the oxidizing atmosphere introduced, in this case, using chlorine trifluoride. Pressure inside the vessel is maintained at about 4 atmospheres and the temperature inside the vessel is maintained at about 100° C. for about 1 hour. At the conclusion of the exposure, the vessel is sequentially evacuated and purged with an inert atmosphere of dry nitrogen while cooling is allowed. Upon observation, the steel particles will be found to possess a coating of metal fluoride. A developer mixture is prepared by mixing the fluoride coated particles with a toner material comprising a styrene-n-butyl methacrylate copolymer and a furnace carbon black wherein the toner material has an average particle size of between about 10 to 15 microns. The coated cores are blended with the toner material in an amount of about 1 part toner material per about 100 parts of carrier material. The developer mixture is used to develop a negatively charged photoconductive surface bearing an electrostatic latent image. The developer mixture will produce images which are of excellent quality with satisfactory background levels.

EXAMPLE V

An electrostatographic carrier material is prepared by placing SAE No. 1015 carbon steel beads (Metals Handbook, 8th Ed., Vol. 1, page 62) having an average particle diameter of about 100 microns in a nickel pressure bomb having a diameter of about 5½ inches and a depth of about 4 inches. The vessel is equipped with a removable flanged top through which pressure and temperature measurements may be made on a continuous basis. The vessel is first evacuated and then filled with dry nitrogen and brought to a temperature of about 300° C. The unreactive nitrogen atmosphere is then removed and the oxidizing atmosphere introduced, in this case, using fluorine gas. Pressure inside the vessel is maintained at about 1 atmosphere and the temperature inside the vessel is maintained at about 300° C. for about ¼ hour. At the conclusion of the exposure, the vessel is sequentially evacuated and purged with an inert atmosphere of dry nitrogen while cooling is allowed. Upon observation, the steel particles will be found to possess a coating of metal fluoride. A developer mixture is prepared by mixing the fluoride coated particles with a toner material comprising a styrene-n-butyl methacrylate copolymer and a furnace carbon black wherein the toner material has an average particle size of between about 10 to 15 microns. The coated cores are blended with the toner material in an amount of about 1 part toner material per about 100 parts of carrier material. The developer mixture is used to develop a negatively charged photoconductive surface bearing an electrostatic latent image. The developer mixture will produce images which are of excellent quality with satisfactory background levels.

Although specific materials and conditions were set forth in the above exemplary processes in making and using the developer materials of this invention, these are merely intended as illustrations of the present invention. Various other toners, carrier cores, substituents and processes such as those listed above may be substituted for those in the examples with similar results.

Other modifications of the present invention will occur to those skilled in the art upon a reading of the present disclosure. These are intended to be included with the scope of this invention.

What is claimed is:

1. An electrostatographic developer mixture for use in reversal development of negatively charged electrostatic latent images, said developer mixture comprising finely-divided toner particles electrostatically clinging to the surface of carrier particles having an average diameter of from between about 30 microns and about 1,000 microns, said carrier particles consisting essentially of a metallic core and a coating thereon consisting essentially of inorganic fluoride, said carrier particles being characterized as possessing negative triboelectric charging properties and said coating having been formed by oxidation of said carrier surface.

2. An electrostatographic developer mixture in accordance with claim 1 wherein said core is magnetically-responsive.

3. An electrostatographic developer mixture in accordance with claim 1 wherein said coating is present in a thickness of from about 10Å to about 100Å.

4. An electrostatographic developer mixture as in claim 3 wherein said metallic core is ferromagnetic.

5. An electrostatographic developer mixture in accordance with claim 1 wherein said coating is present in a quantity sufficient to form a substantially continuous film over said core.

6. An electrostatographic developer mixture in accordance with claim 1 wherein said core is selected from the group consisting of iron, steel, ferrite, and nickel.

7. An electrostatographic imaging process comprising the steps of providing an electrostatographic imaging member having a recording surface, forming a negatively charged electrostatic latent image on said recording surface, and contacting said electrostatic latent image with a developer mixture comprising finely-divided toner particles electrostatically clinging to the surface of carrier particles having an average diameter of from between about 30 microns and about 1,000 microns, said carrier particles consisting essentially of a metallic core and a coating thereon consisting essentially of inorganic fluoride, said carrier particles being characterized as possessing negative triboelectric charging properties, whereby at least a portion of said finely-divided toner particles are attracted to and deposited on said recording surface in conformance with said electrostatic latent image, said coating having been formed by oxidation of said carrier surface.

* * * * *